US009894984B2

(12) United States Patent
Accetura, Jr.

(10) Patent No.: US 9,894,984 B2
(45) Date of Patent: Feb. 20, 2018

(54) DUAL-PURPOSE HAIR STYLING AND RETENTION DEVICE AND METHOD OF USE THEREOF

(71) Applicant: CROWNSTYLER, INC., Fort Lauderdale, FL (US)

(72) Inventor: Robert Joseph Accetura, Jr., Fort Lauderdale, FL (US)

(73) Assignee: Crownstyler, Inc., Fort Lauderdale, FL (US)

( * ) Notice: Subject to any disclaimer, the term of this patent is extended or adjusted under 35 U.S.C. 154(b) by 0 days.

(21) Appl. No.: 15/191,873

(22) Filed: Jun. 24, 2016

(65) Prior Publication Data

US 2017/0367468 A1 Dec. 28, 2017

(51) Int. Cl.

| | |
|---|---|
| ***A45D 24/10*** | (2006.01) |
| ***A46B 5/00*** | (2006.01) |
| ***A45D 8/28*** | (2006.01) |
| ***A45D 8/32*** | (2006.01) |

(52) U.S. Cl.

CPC ..... *A46B 5/002* (2013.01); *A45D 8/28* (2013.01); *A45D 8/32* (2013.01)

(58) Field of Classification Search

CPC ... A45D 8/20; A45D 8/22; A45D 8/28; A45D 8/30; A45D 8/32; A46B 5/002; A46B 5/0033; A46B 5/0041; A46B 5/0054; A46B 5/0079; A46B 5/0083; B25G 1/00

USPC ..... 15/143.1, 144.3, 185

See application file for complete search history.

(56) References Cited

U.S. PATENT DOCUMENTS

| | | | | | |
|---|---|---|---|---|---|
| 1,777,516 | A | * | 10/1930 | Castle | A46B 5/0033 15/160 |
| 1,831,667 | A | * | 11/1931 | Johnson | A46B 5/0033 132/103 |
| 2,523,073 | A | * | 9/1950 | Stacey | A46B 5/0033 15/144.1 |
| 5,323,793 | A | | 6/1994 | Lorenzi | |
| 5,533,533 | A | | 7/1996 | Shing | |
| 5,546,966 | A | * | 8/1996 | Lin | A45D 8/24 132/276 |
| 5,605,166 | A | | 2/1997 | Chou | |
| 5,638,836 | A | * | 6/1997 | Yasuda | A45D 24/10 132/145 |
| D393,927 | S | | 4/1998 | Chou | |

(Continued)

*Primary Examiner* — Todd E Manahan
*Assistant Examiner* — Jennifer Gill
(74) *Attorney, Agent, or Firm* — The Concept Law Group, P.A.; Scott M. Garrett

(57) ABSTRACT

A dual-purpose hair styling and retention device including a curved handle having a top surface couplable to a user's head and a bottom surface opposite the top surface, the top surface and the bottom surface forming a hand gripping surface. The dual-purpose hair styling and retention device also includes a base pivotally coupled to the handle, the base having an upper surface and a bottom surface opposite the upper surface, the upper surface including a plurality of bristles coupled thereto. The dual-purpose hair styling and retention device further includes an extended configuration in which the handle extends from the base to expose the hand gripping surface and a hair-retention configuration in which the base is selectively coupled to the bottom surface of the handle to at least partially obstruct the hand gripping surface and expose the plurality of bristles.

6 Claims, 11 Drawing Sheets

(56) References Cited

U.S. PATENT DOCUMENTS

| | | | | |
|---|---|---|---|---|
| 5,816,267 | A | 10/1998 | Chou | |
| 5,921,252 | A | 7/1999 | Chubb | |
| 6,186,151 | B1 | 2/2001 | Newlin | |
| 6,196,235 | B1 * | 3/2001 | Kim | A46B 5/0033 132/148 |
| 6,438,785 | B1 * | 8/2002 | Smith | A46B 5/02 132/120 |
| 6,446,639 | B1 | 9/2002 | Shyu | |
| 7,356,871 | B2 * | 4/2008 | Heaven | B25G 1/04 15/143.1 |
| 2010/0236004 | A1 * | 9/2010 | Xu | A46B 5/0095 15/160 |
| 2014/0053358 | A1 * | 2/2014 | Costa | A46B 5/0041 15/171 |
| 2014/0189971 | A1 * | 7/2014 | Watson | A46B 5/0033 15/106 |
| 2014/0191634 | A1 | 7/2014 | Smiley | |
| 2015/0055999 | A1 * | 2/2015 | Lim | A45D 33/006 401/125 |

* cited by examiner

DUAL-PURPOSE HAIR STYLING AND RETENTION DEVICE AND METHOD OF USE THEREOF

FIELD OF THE INVENTION

The present invention relates generally to hair devices, and, more particularly, relates to a dual-purpose hair styling and retention device.

BACKGROUND OF THE INVENTION

Frequent visits to hair salons are an important part of maintaining healthy and attractive hair. Of course, such visits typically require a considerable amount of a person's time, especially for people with thick and/or long hair. Often, the amount of time spent at the hair salon is a direct result of the hair stylists' need to brush and restrain the hair in sections using a brush and one or more styling clips, and/or other hair restraint devices, i.e., hair styling tools. Of course, once the hair is separated into the desired sections, the hair stylist can cut, blow-dry, and/or style the hair. Unfortunately, using numerous separate hair styling tools and clips is time consuming and tedious, especially when the clips hold only a minimal amount of hair and are difficult to insert within and take out of someone's hair. Often the chair in which the subject sits during hairstyling is disposed a distance away from a table on which hair styling tools may be placed. Accordingly, it may be inconvenient and time consuming for the hair stylist to continuously remove the clips, set the clips on the table, and pick the clips up again for reuse throughout the hair styling process. As an added problem, using numerous hair styling tools and clips is costly for the hair stylist. Of course, styling hair at home also suffers from a number of these draw backs, including, but not limited to, the large amount of time consumed continuously removing and reusing the clips and the cost of purchasing numerous hair clips.

At least one known hair apparatus for grooming and decorating hair is described in U.S. Pat. No. 6,186,151 and depicted in FIG. 11. The apparatus includes a hair clip and a grooming device, i.e., a small brush. The problems with the hair apparatus presented in U.S. Pat. No. 6,186,151 are numerous. For example, the narrow width of the hair clip and the minimal number of jaws included on the hair clip are unsuitable for holding a substantial amount of hair. As a result, a hair stylist would need to use more than one of the hair clips to separate someone's hair in sections. This is not only time consuming for the hair stylist who could have otherwise booked additional appointments, but is also inconvenient for the person who is having his or her hair styled. As an added problem, the jaws are susceptible to becoming tangled in the hair and often break, leading to discomfort and the need to consistently replace the hair clips. Moreover, as a result of the narrow width of the grooming device, the grooming device is unsuitable for brushing a substantial amount of hair. As such, the hair stylist must run the grooming device through the hair numerous times in order to brush someone's hair.

U.S. Pat. No. 5,816,267 describes a barrette combined with a comb. The barrette is designed to be adjusted subject to the volume of hair to be clamped. The barrette is also designed to be converted into a hairbrush. The barrette, shown in U.S. Pat. No. 5,816,267, includes an elongated base plate, a comb strip, and a clamping plate. The comb strip includes a number of teeth extending therefrom. Unfortunately, the barrette cannot be easily inserted into someone's hair without become tangled, nor can the barrette hold a substantial amount of hair. As such, the barrette would not be suitable for use in a hair salon by a hair stylist who needs to separate and retain large sections of someone's hair quickly and efficiently. In the same vein, the barrette, due to the rows of spaced teeth, is not conducive for brushing a substantial amount of the user's hair.

U.S. Pat. No. 5,638,836 describes a hair clip including a base plate having comb-tooth-shaped lugs and a hair retainer connected to the base plate. The hair retainer has one end that opens and closes with respect to the base plate. The lugs are designed to retain someone's hair between the base plate and the hair retainer when the hair clip is closed. In the closed configuration, the lugs grip only the minimal amount of hair that can fit between the base plate and the hair retainer. In an open configuration, the hair retainer is swingable away from the base plate only up to a limited angle. The lugs are then exposed for use as a hair brush, with the hair retainer intended to serve as a handle. Unfortunately, as a result of the limited angle, the hair clip cannot completely fold so that the back surfaces of the base plate and the hair retainer touch each other. Thus, the hair clip is not designed to allow the back surface of the handle to sit on someone's head with the lugs exposed so that large sections of the hair can be placed over and retained by the lugs.

Other known hair devices which serve the dual-purposes of combing and restraining someone's hair often provide the user with a comb and hair clip combination having numerous moving parts. Such parts are susceptible to breaking, requiring the user to replace the parts or the entire hair device. Moreover, such comb and hair clip combinations can only hold small amounts of hair at a time. Thus, a hair stylist would need to use numerous clips to restrain sections of the hair. Additional known hair devices include foldable hair brushes which fail to provide the ability to restrain the user's hair.

Therefore, a need exists to overcome the problems with the prior art as discussed above.

SUMMARY OF THE INVENTION

The invention provides a dual-purpose hair styling and retention device and method of use thereof that overcomes the hereinafore-mentioned disadvantages of the heretofore-known devices and methods of this general type and that provides an operator with the ability to style and restrain someone's hair quickly and efficiently using a single device.

With the foregoing and other objects in view, there is provided, in accordance with the invention, a dual-purpose hair styling and retention device including a handle having a curved top surface couplable to a user's head and a bottom surface opposite the top surface, the top surface and the bottom surface forming a hand gripping surface, a base pivotally coupled to the handle, the base having an upper surface and a bottom surface opposite the upper surface, the upper surface including a plurality of bristles coupled thereto, an extended configuration in which the handle extends from the base to expose the hand gripping surface, and a hair-retention configuration in which the bottom surface of the base is selectively coupled to the bottom surface of the handle to at least partially obstruct the hand gripping surface and expose at least a portion of the plurality of bristles.

In accordance with another feature, an embodiment of the present invention includes the base having a length and a width and the plurality of bristles having at least three rows of bristles substantially spanning the length and the width of the base.

In accordance with a further feature of the present invention, the dual-purpose hair styling and retention device includes a flexible coupling member pivotally coupling the base to the handle and a housing substantially concealing the flexible coupling member when the base and the handle are in the hair-retention configuration.

In accordance with a further feature of the present invention, the top surface of the handle may be shaped to contour a user's head.

In accordance with another feature, an embodiment of the present invention also includes the dual-purpose hair styling and retention device having a first magnet coupled to the handle and a second magnet coupled to the base, the first and second magnets configured to magnetically retain the bottom surface of the base to the bottom surface of the handle in the hair-retention configuration.

In accordance with yet another feature, an embodiment of the present invention includes the dual-purpose hair styling and retention device having a male fastener coupled to the base and a female fastener coupled to the handle, the male fastener of the base sized and shaped to insert within the female fastener of the handle.

In accordance with a further feature of the present invention, the upper surface and the bottom surface of the base may each include a curved shape.

In accordance with another feature, an embodiment of the present invention includes the dual-purpose hair styling and retention device having a curved handle including a top head contact surface, a bottom surface opposite the top head contact surface and a first retaining member interposed between the top head contact surface and the bottom surface, and a base pivotally coupled to the handle, the base having an upper portion having a plurality of protrusions coupled thereto, a lower portion opposite the upper portion, and a second retaining member interposed between the upper portion and the lower portion, the first and second retaining members adapted to couple the lower portion of the base to the bottom surface of the handle.

In accordance with a further feature of the present invention, the handle includes a handle housing for retaining the first retaining member therein and the base includes a base housing for retaining the second retaining member therein.

In accordance with another feature of the present invention, the first and second retaining members are magnets.

In accordance with a further feature of the present invention, the base includes a length and a width and the plurality of protrusions include at least two rows of protrusions substantially spanning the length and the width of the base.

In accordance with another feature of the present invention, the dual-purpose hair styling and retention device includes a flexible coupling member coupling the handle to the base.

In accordance with another feature of the present invention, the dual-purpose hair styling and retention device may include an open configuration including the handle extending from the base to expose a hand gripping surface of the handle and a closed configuration including the lower portion of the base coupled to the bottom surface of the handle to at least partially obstruct the hand gripping surface and expose a free end of each of the plurality of protrusions to an external environment.

In accordance with yet another feature of the present invention, the dual-purpose hair styling and retention device may include a male fastener coupled to the base and a female fastener coupled to the handle, the male fastener sized and shaped to insert within the female fastener of the handle.

In accordance with the present invention, a method for styling and retaining hair includes providing a dual-purpose hair styling and retention device, the dual-purpose hair styling and retention device including a handle including a curved top surface couplable to a user's head and a bottom surface opposite the top surface, the top surface and the bottom surface together forming a hand gripping surface, a base pivotally coupled to the handle, the base having an upper surface and a bottom surface opposite the upper surface, the upper surface including a plurality of bristles coupled thereto, an extended configuration in which the handle extends from the base to expose the hand gripping surface, and a hair-retention configuration in which the bottom surface of the base is selectively coupled to the bottom surface of the handle to at least partially obstruct the hand gripping surface, coupling the top surface of the handle to a user's head, and coupling the bottom surface of the base to the bottom surface of the handle.

In accordance with another feature of the present invention, the method may include, after the coupling steps and while the dual-purpose hair styling and retention device is coupled to a user's head, placing at least one section of a user's hair in contact with the plurality of bristles.

In accordance with another feature of the present invention, the method may include providing the dual-purpose hair styling and retention device having a first magnet coupled to the handle and a second magnet coupled to the base, the first and second magnets configured to magnetically retain the bottom surface of the base to the bottom surface of the handle.

In accordance with yet another feature of the present invention, the method may include decoupling the bottom surface of the base from the bottom surface of the handle, grasping the hand gripping surface of the handle, and styling a user's hair with the plurality of bristles in contact with the user's hair.

Although the invention is illustrated and described herein as embodied in a dual-purpose hair styling and retention device and method of use thereof, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the hair device.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
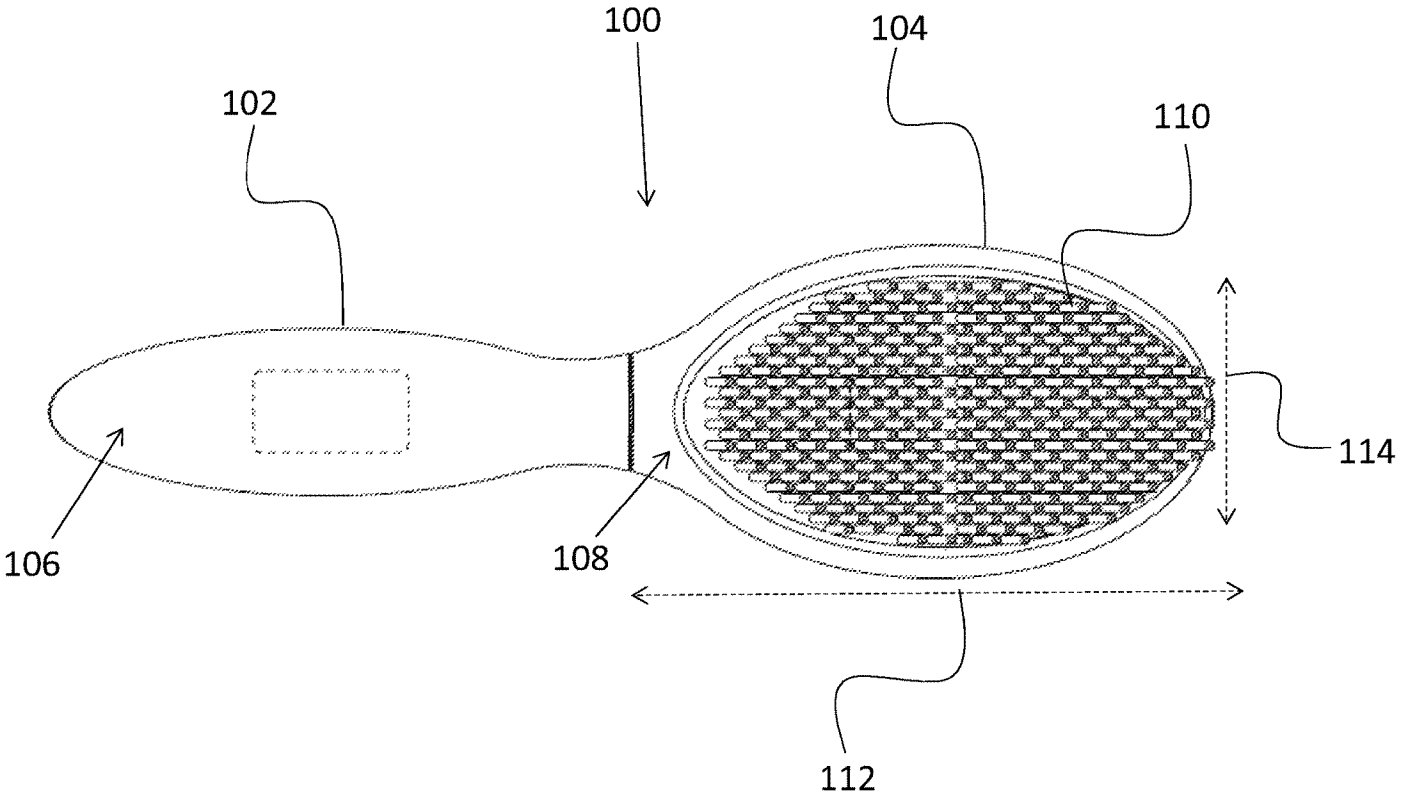
FIG. 1 is a top plan view of a dual-purpose hair styling and retention device in an extended configuration and having a handle pivotally coupled to a base and a plurality of bristles coupled to the base.

While the specification concludes with the claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient dual-purpose hair styling and retention device that provides an operator, such as a hair stylist, with the ability to both style and restrain sections of someone's hair using a single device. Embodiments of the invention provide the dual-purpose hair styling and retention device having a handle and a base pivotally coupled to the handle, wherein the handle and the base may be translated from an extended configuration to a hair-retention configuration. In the extended configuration, the operator is provided full access to a hand gripping surface of the handle to style someone's hair in a manner similar to using a traditional hairbrush. In the hair-retention configuration, the operator may simply slide the handle into the user's hair and pivot the base so that the base folds over and makes contact with the handle, while leaving one or more bristles exposed to an ambient environment and facing in a direction away from the user's head. Advantageously, the operator may lay sections of the user's hair over the bristles to retain the sections of the user's hair on top of the user's head, thereby allowing the operator to cut, blow-dry, curl, or otherwise style the unrestrained sections of the user's hair in a quick and efficient manner. Embodiments of the invention provide the handle and the brush each having magnets configured to magnetically retain the brush to the handle.

Referring now to FIG. 1, one embodiment of the present invention is shown in a top plan view. FIG. 1 shows several advantageous features of the present invention, but, as will be described below, the invention can be provided in several shapes, sizes, combinations of features and components, and varying numbers and functions of the components. The first example of a dual-purpose hair styling and retention device 100, as shown in FIG. 1, includes a handle 102 pivotally coupled to a base 104. FIG. 1 depicts the handle 102 and the base 104 in an extended configuration suitable for styling someone's hair with the device 100. More specifically, in one embodiment, the extended configuration includes the handle 102 extending from the base 104 along substantially the same horizontal plane, e.g., allowing some deviation from the same horizontal plane as a result of the curved shape of the device. In other embodiments, the extended configuration may include the handle 102 extending from the base 104 along different horizontal planes.

Figure 2:
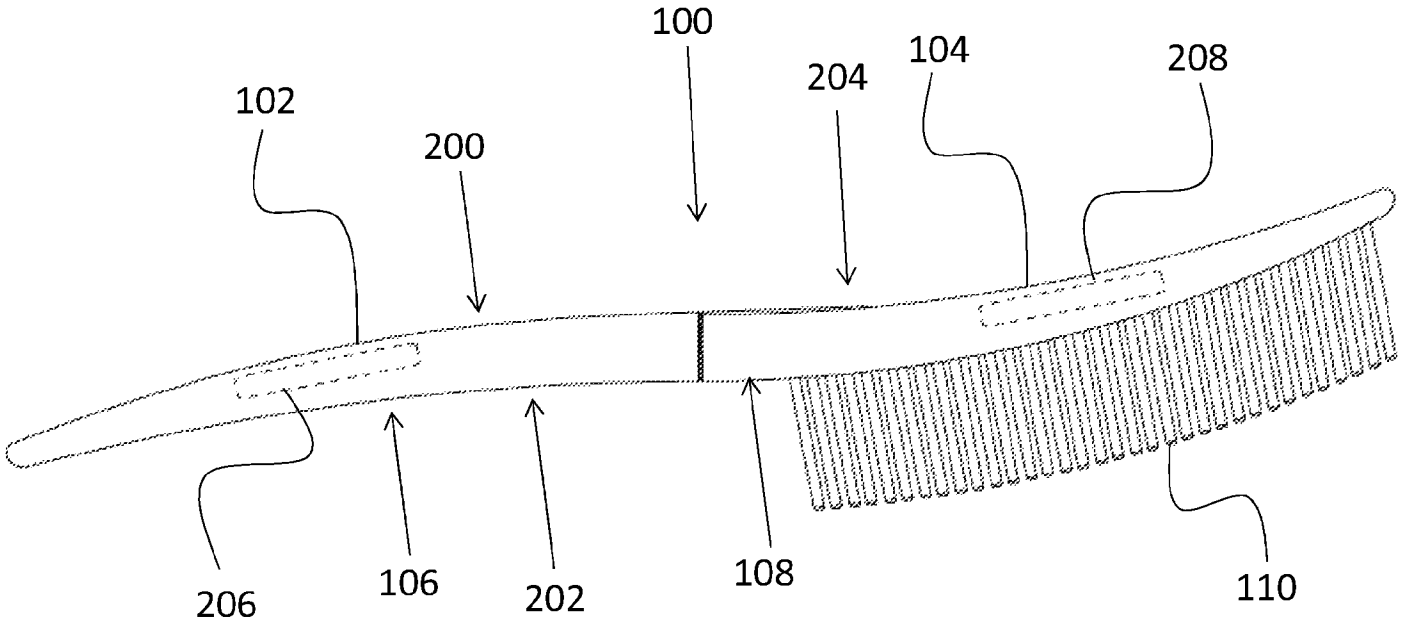
FIG. 2 is an elevational side view of the dual-purpose hair styling and retention device of FIG. 1 depicting the handle and the base having a curved configuration and a first retaining member coupled to the handle and a second retaining member coupled to the base.
Figure 10:
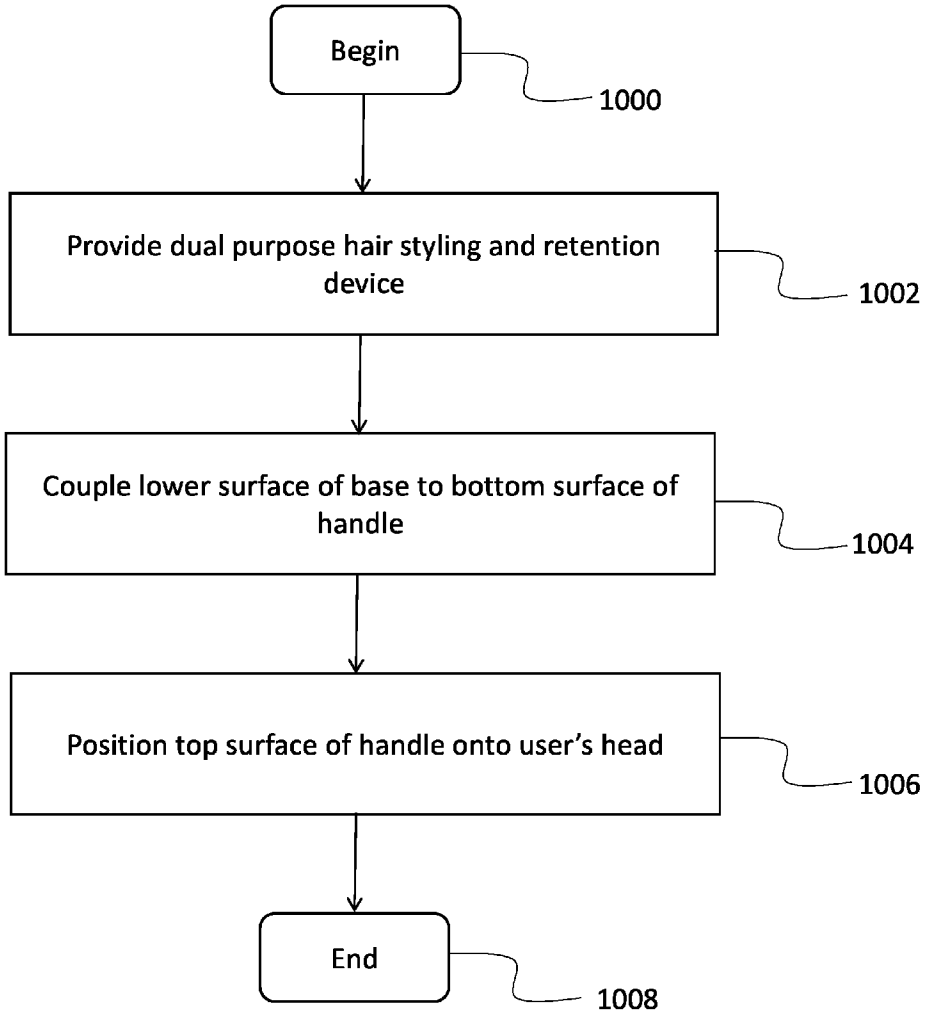
FIG. 10 is an exemplary process-flow diagram depicting a method of styling and retaining hair using a dual-purpose hair styling and retention device in accordance with one embodiment of the present invention.
Figure 11:
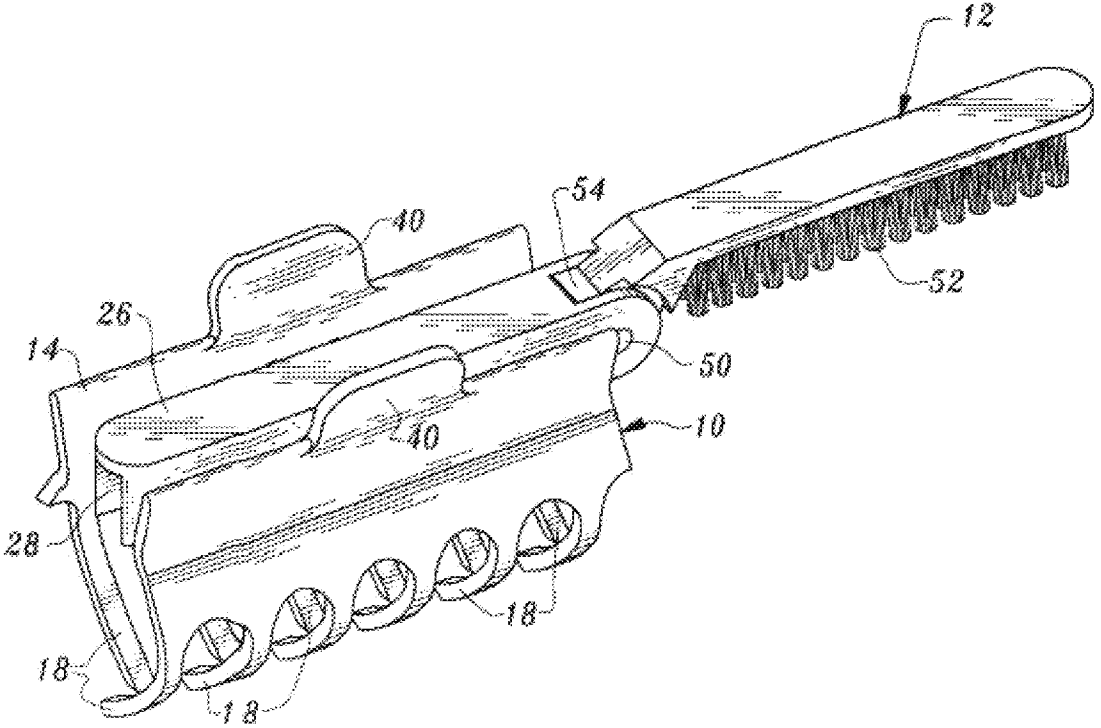
PRIOR ART FIG. 11
FIG. 11 is a perspective view of a prior art apparatus for grooming and decorating hair.

With reference to FIGS. 1 and 2, in conjunction with the process flow diagram of FIG. 10, there is provided a method of styling and retaining hair using a dual-purpose hair styling and retention device, such as the device 100. Although FIG. 10 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 10 for the sake of brevity. In some embodiments, some or all of the process steps included in FIG. 10 can be combined into a single process.

In one embodiment, the method begins at step 1000 and moves directly to step 1002, which includes providing a dual-purpose hair styling and retention device, such as the device 100 having the handle 102 including a top surface 106 and a bottom surface 200 (FIG. 2) opposite the top surface 106. The present method is not limited to use with the device 100; rather, may be used with other dual-purpose hair styling and retention devices as well.

In one embodiment, the top surface 106 and the bottom surface 200 (FIG. 2) of the handle 102 together form a hand gripping surface 202 for an operator's hand to grip when styling someone's hair. As best seen in FIG. 2, depicting an elevational side view of the device 100 in the extended configuration, the hand gripping surface 202 is exposed such that the operator may grip the handle 102 with the operator's fingers in contact with the top surface 106 and the operator's palm in contact with the bottom surface 200, similar to gripping a standard hair brush. The term "operator" may be, without limitation, a hairstylist i.e., a person separate from the user, or the operator may be the user who chooses to style his or her own hair. In one embodiment, the handle 102 may include an anti-slip covering (not shown) which can be made of any friction-inducing material, e.g., rubber, having a coefficient of friction greater than the base 104. Advantageously, the anti-slip covering prevents the user's hand from sliding on the hand gripping surface 202.

In order to style the user's hair, in one embodiment, the base 104 includes an upper surface 108 having one or more bristles 110 coupled thereto and a bottom surface 204 (FIG. 2) opposite the upper surface 108. The term "bristle" is defined herein in its broadest possible sense as a protrusion configured to detangle, smooth, brush or otherwise style someone's hair. The bristles 110 are not limited to any particular material. For example, the bristles 110 may be comfort tip bristles, nylon, or any synthetic or non-synthetic material.

As best shown in FIG. 1, in one embodiment, the base 104 includes a length 112 and a width 114, with at least two rows of bristles 110 substantially spanning the length 112 and the width 114. The term "substantially spanning" is defined herein as spanning at least 65-75% of the length 112 and the width 114 of the upper surface 108 of the base 104, while allowing nominal spacing between the bristles 110 so that the bristles 110 may bend and flex. In another embodiment, the bristles 110 may cover less than 65-75% of the length 112 and the width 114 of the upper surface 108 of the base 104. Naturally, the length 112 and the width 114 of the base 104 may vary. In one non-limiting embodiment, the length 112 may be between approximately 2-4 inches and the width 114 may be between approximately 2-3 inches. In other embodiments, the length 112 and the width 114 may be outside of these ranges. In the same vein, the base 104 may include one row of bristles 110, although having at least two rows of bristles is a preferred configuration. The number of bristles 110 may be any number suitable for styling someone's hair. The rows of bristles 110 are advantageous for not only quickly and efficiently styling the user's hair, especially when compared to a general purpose comb or standard hair clip, but also provide the operator with the ability to retain the hair on top of the user's head when styling, as will be explained in further detail herein.

Figure 3:
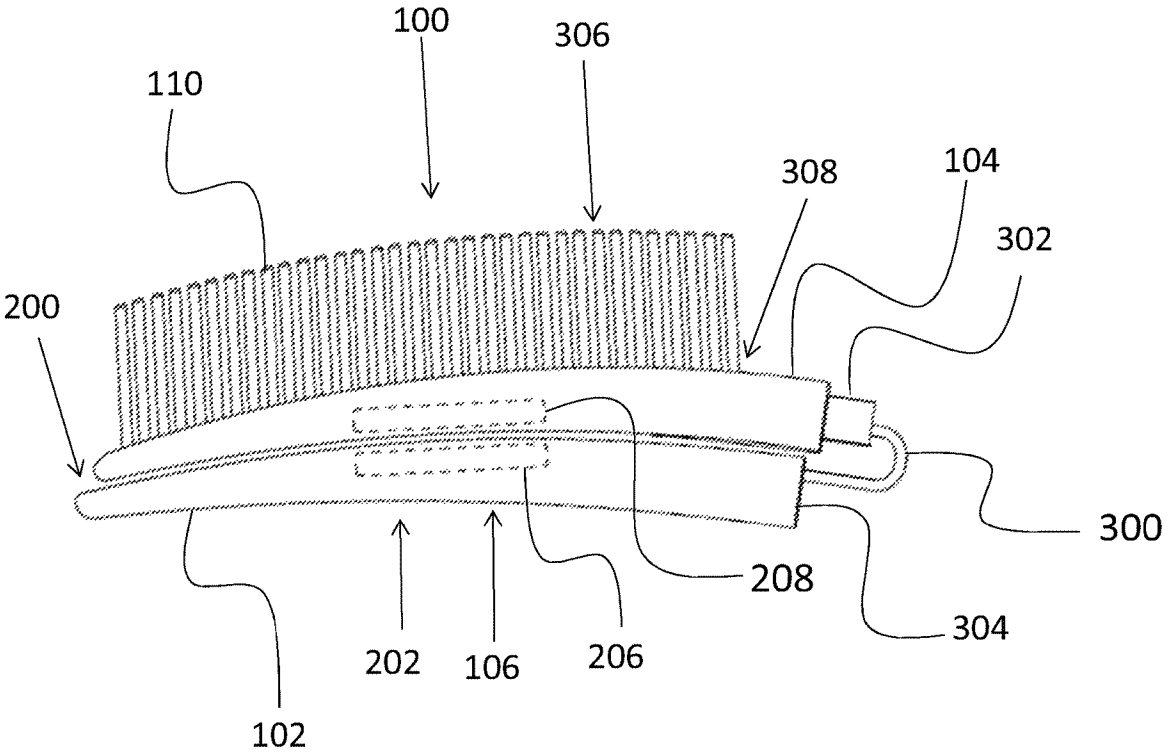
FIG. 3 is an elevational side view of the dual-purpose hair styling and retention device of FIG. 1 in a hair-retention configuration including a flexible coupling member coupling the handle to the base and the first and second coupling members magnetically retaining the handle to the base.

With reference now to FIGS. 2 and 3, the top surface 106 of the handle 102 is depicted having a curved configuration, i.e., shape, suitable for positioning the top surface 106 of the handle 102 in contact with a user's head. As one of skill in the art can appreciate, the degree of curvature may vary and the device 100 is not limited to a particular degree of curvature. In one embodiment, the degree of curvature of the top surface 106 may be formed so as to naturally and comfortably conform to a top surface of a standard user's head when in the hair-retention configuration. Stated another way, and as can be seen in FIG. 3, the top surface 106 of the handle 102 has a concave curvature shaped to contour to a top of a user's head in the hair-retention configuration. As such, the top surface 106 of the handle 102 may be referred to as a top head contact surface. In other words, as can be seen in FIG. 3, the top head contact surface has a concave curvature, in the direction away from the plurality of bristles, that is shaped to conform to a top of a user's head when the lower portion of the base 104 is coupled to the bottom surface 200 of the handle 102. In the same vein, in one embodiment, the base 104 may also include a curved configuration suitable for contouring to the handle 102 when the device 100 is translated from the extended, i.e., open, configuration (FIG. 2) to the hair-retention, i.e., closed, configuration (FIG. 3).

In one embodiment, in step 1004, the device 100 may be translated from the extended configuration (FIG. 2) to the hair-retention configuration (FIG. 3) using a flexible coupling member 300 (FIG. 3) pivotally coupling the base 104 to the handle 102. In one embodiment, the flexible coupling member 300 is a rubber insert. In other embodiments, the flexible coupling member 300 may be a hinge, joint, or another coupling member suitable for coupling the base 104 to the handle 102, while allowing the base 104 to pivot with respect to the handle 102. As one of ordinary skill in the art can appreciate, the handle 102 may also pivot with respect to the base 104.

As best shown in FIG. 3, in order to couple the base 104 to the handle 102 and translate the device 100 between the extended and hair-retention configurations, the flexible coupling member 300 is interposed between a male fastener 302 coupled to the base 104 and a female fastener 304 coupled to the handle 102. In one embodiment, the male fastener 302 is a protrusion fixedly coupled to the base 104 and the female fastener 304 is a channel defined by the handle 102, for receiving and concealing the male fastener 302 therein in the extended configuration (as can be seen in FIG. 2). In other embodiments, the male fastener 302 and the female fastener 304 may be other types of fasteners suitable for coupling the base 104 to the handle 102.

FIG. 3 depicts the hair-retention configuration including the base 104 coupled to the bottom surface 200 of the handle 102 to at least partially obstruct the hand gripping surface 202. Said another way, in the hair-retention configuration, because the bottom surface 200 of the handle 102 is in contact with the base 104, the user is prevented from fully grasping the hand gripping surface 202. With brief reference to FIG. 4, in one embodiment, when the device 100 is in the hair-retention configuration, the operator may style the user's hair using the device 100 by grasping a right side 400 and a left side 402 of the base 104. As such, the device 100 is not limited to use for styling, e.g., brushing, hair only in the extended configuration; rather, the device 100 may be used to style someone's hair in the hair-retention configuration as well. The bottom surface 204 of the base 104 may or may not include an anti-slip grip.

Figure 4:
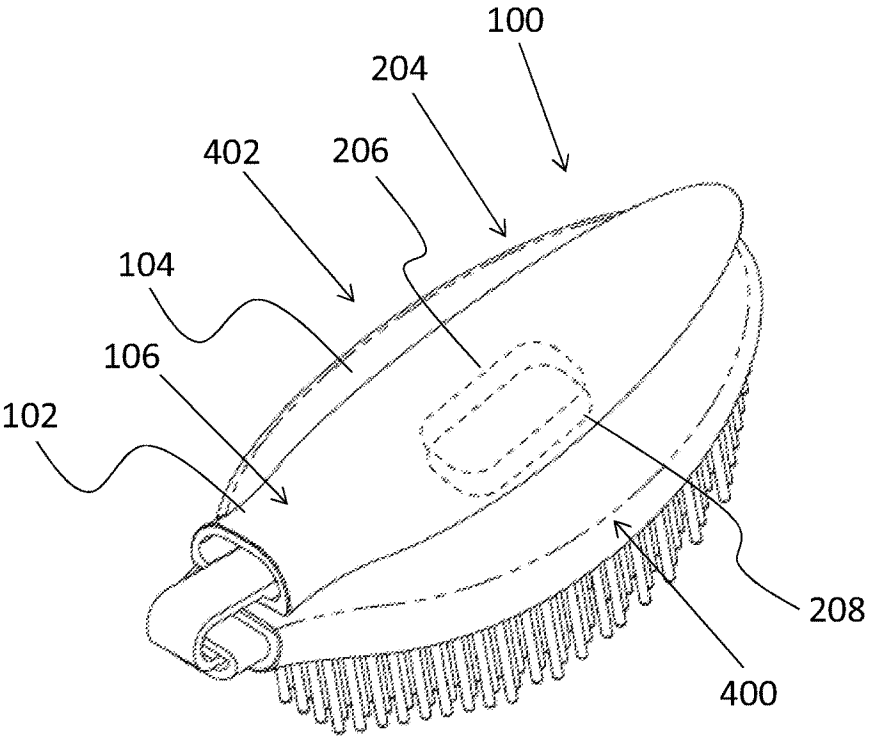
FIG. 4 is a perspective bottom view of the dual-purpose hair styling and retention device of FIG. 1 depicting a bottom surface of the handle coupled to a bottom surface of the base using the first and second coupling members to magnetically retain the handle to the base.

With reference to FIGS. 3 and 4, in a preferred embodiment, when the device 100 is in the hair-retention configuration, in step 1006, the top surface 106 of the handle 102 may be positioned on top of the user's head and/or at the crown of the user's head. More specifically, the handle 102 may be inserted into the user's hair and positioned at the top/and or crown of the user's head. Advantageously, the curved shape of the handle 102 (FIG. 2) is conducive not only for contouring against the user's head but also provides comfort to the user.

Figure 5:
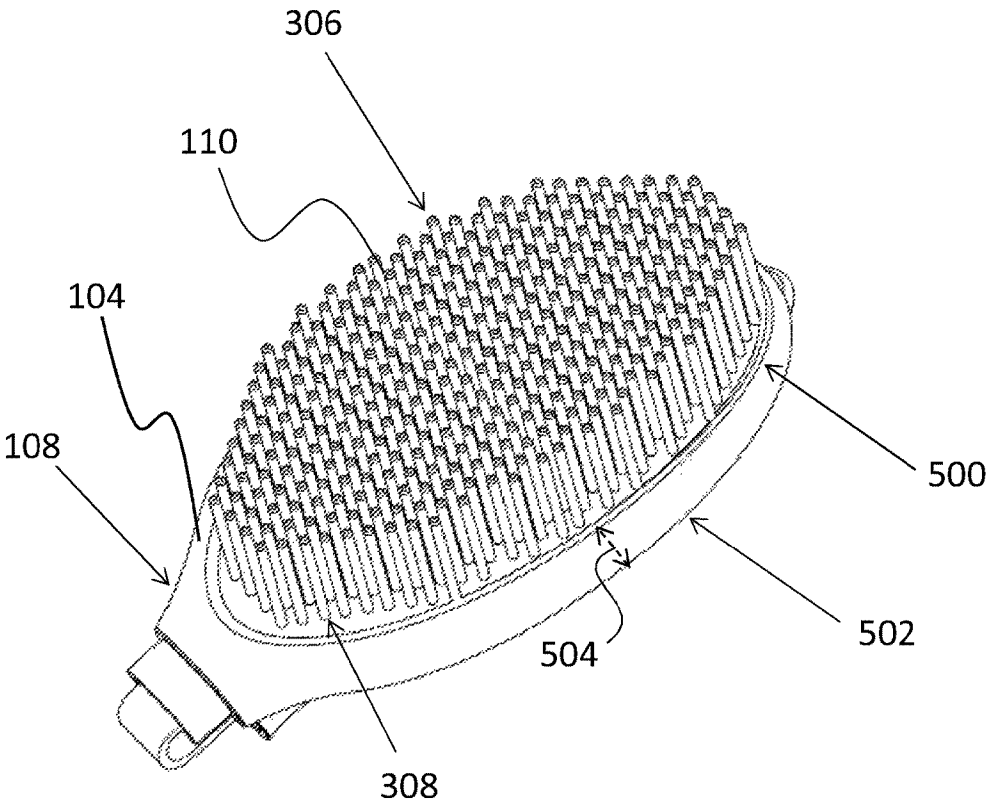
FIG. 5 is a perspective top view of the folded dual-purpose hair styling and retention device of FIG. 4 depicting the plurality of bristles coupled to an upper surface of the base.
Figure 6:
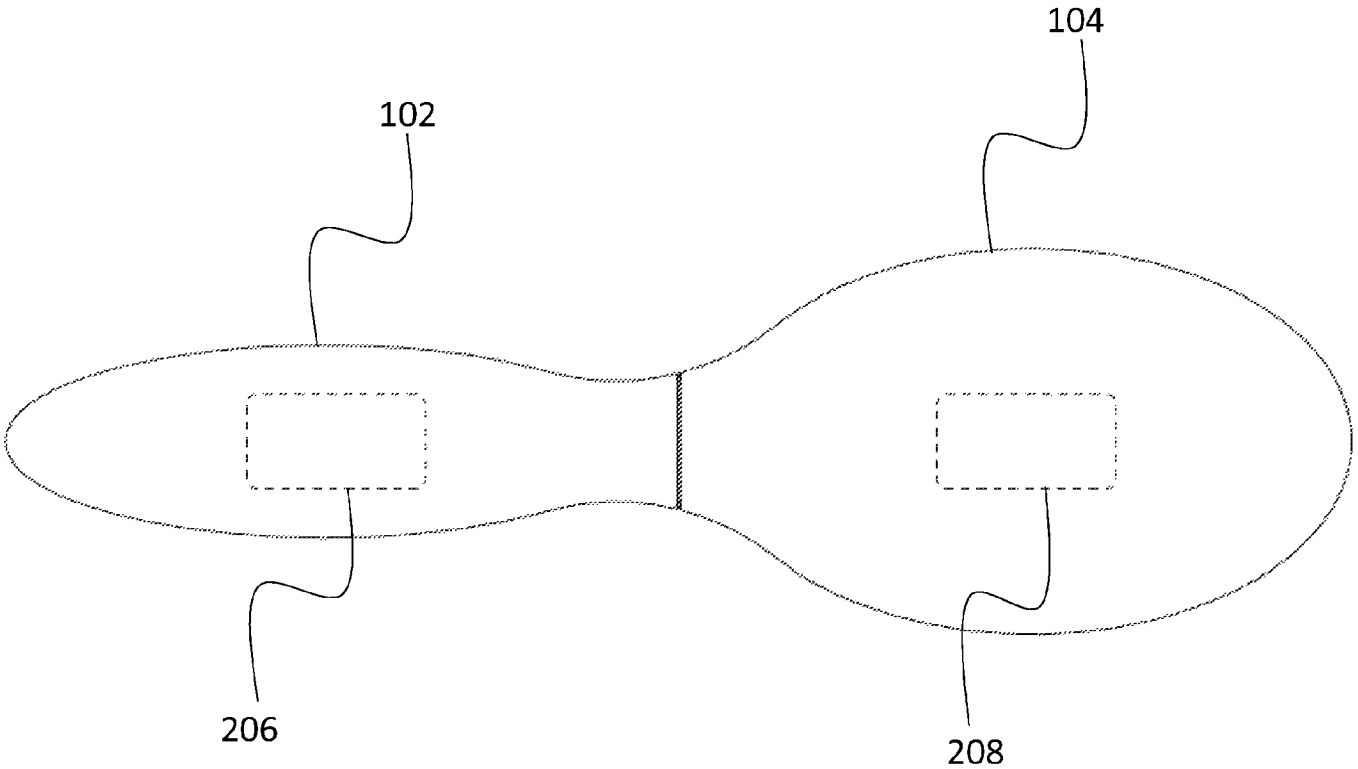
FIG. 6 is a bottom plan view of the dual-purpose hair styling and retention device of FIG. 1 depicting the first and second retaining members in accordance with an exemplary embodiment of the present invention.

With reference to FIGS. 3 and 5, in the hair-retention configuration, the bristles 110 are configured to extend in a direction away from the user's head. In this manner, the device 100 can be said to resemble a crown. More specifically, in the hair-retention configuration, a free end 306 of each of the bristles 110 is unobstructed and exposed to an outside ambient environment. As such, the free end 306 of the bristles 110 is free and operable to receive a portion of someone's hair within the bristles 110 to frictionally retain such portion away from a remainder portion of the hair that is available for styling. In one embodiment, the operator may place one or more sections of someone's hair in contact with the free end 306 of the bristles 110 to retain the user's hair on or around the bristles 110. Advantageously, the bristles 110 provide the operator with the ability to style the user's hair in a quick and efficient manner because the bristles 110 can hold relatively large sections of the hair. In the same vein, the hair can be taken from the bristles 110 in sections without the need to clip and unclip the hair from numerous separate styling clips, elastic members, or the like. The design of the bristles 110 also prevents the hair from becoming tangled therein. This presents a significant advantage over hair clips having jaws that become tangled within someone's hair. The unrestrained sections, i.e., sections of the user's hair not in contact with the bristles 110, may be cut, blow-dried, styled with a curling iron, flat ironed, or otherwise styled by the operator. The free end 306 includes a terminal end of the bristle 110 and is located opposite from a retention end 308 of each of the bristles 110. The retention end 308 of the bristles 110 is the end coupled to the base 104. As mentioned above, the operator may utilize the device 100 to style his or her own hair, i.e., the operator may be the user. In one non-limiting example, the operator may be the hair stylist who teaches the user to style his or her own hair at home using the device 100. In any event, the operator or user may learn to utilize the device 100 independently and without any assistance from another person.

With specific reference to FIG. 5, the base 104 is depicted having an upper portion 500 and a lower portion 502. In one embodiment, the upper portion 500 and the lower portion 502 each comprise approximately half of a height 504 of the base 104. In other embodiments, the upper and lower portions 500, 502 comprise variable portions of the height 504 of the base 104. In one embodiment, the height 504 is approximately 0.25-0.5 inches. In other embodiments, the height 504 may be outside of this range. Naturally, the upper portion 500 includes the upper surface 108 of the base 104 and the lower portion 502 includes the bottom surface 204 of the base 104 (FIG. 2). The bristles 110 are not limited to being coupled to the upper surface 108 of the base 104; rather, may be coupled anywhere within the upper portion 500 of the base 104, e.g., below the upper surface 108, or may extend to the lower portion 502. Said another way, the bristles 110 may extend through the upper surface 108 of the base 104 such that the bristles are coupled to the upper portion 500 or the lower portion 502 at a region below the upper surface 108.

With reference to FIGS. 2-4 and 6-7, in one embodiment, in order to retain the handle 102 to the base 104, and vice-versa, the device 100 includes a first retaining member 206 coupled to the handle 102 and a second retaining member 208 coupled to the base 104. In a preferred embodiment, the first retaining and second retaining members 206, 208 are magnets configured to magnetically retain the bottom surface 204 of the base 104 to the bottom surface 200 of the handle 102. In other embodiments, the first and second retaining members 206, 208 may be other types of retaining members 206, 208. In one embodiment, the first and second retaining members 206, 208 may be embedded in the handle 102 and the base 104. In another embodiment, the first and second retaining members 206, 208 may be provided on an exterior surface of each of the handle 102 and the base 104.

Figure 7:
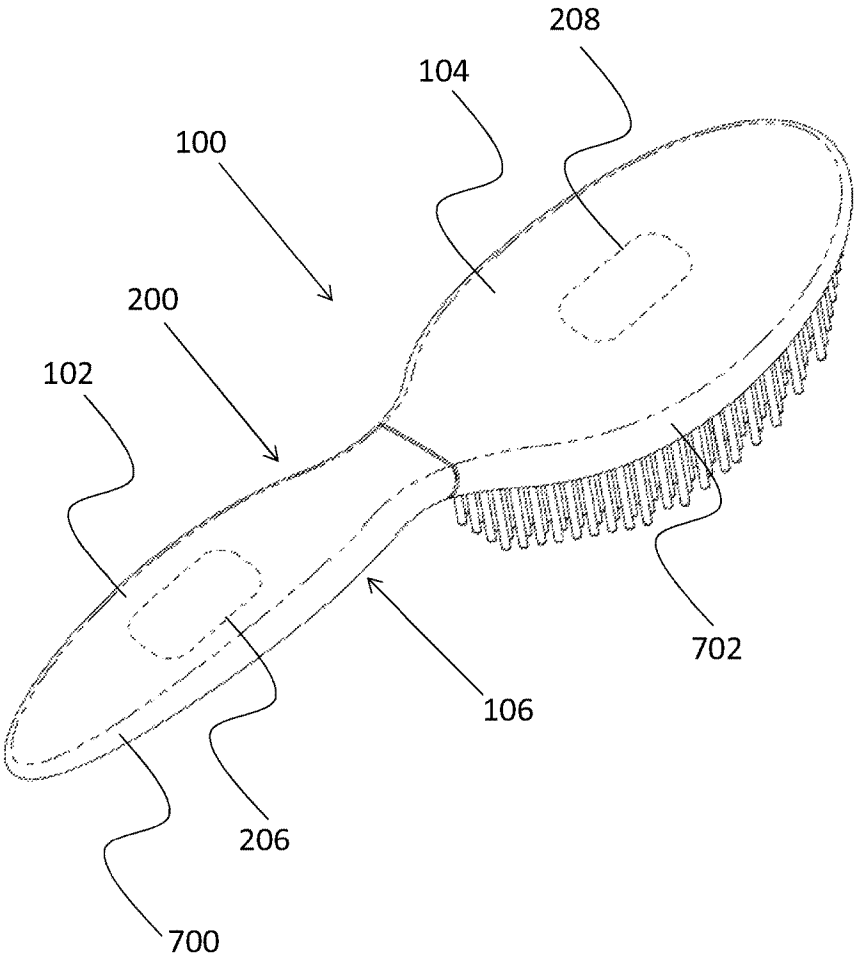
FIG. 7 is a perspective rear view of the dual-purpose hair styling and retention device of FIG. 1 depicting a handle housing and a base housing configured to retain the first and second retaining members therein.

With reference to FIG. 7, depicting the device 100 in a downward looking perspective view, the first retaining member 206 is shown interposed between the top and bottom surfaces 106, 200 of the handle 102. In one embodiment, the handle 102 includes a handle housing 700 for retaining, i.e., holding, the first retaining member 206 therein. More specifically, in one embodiment, the handle housing 700 includes a first retaining member pocket (not shown) that is molded or otherwise created during the manufacturing process of the device 100. The first retaining member pocket may be sized and shaped to hold the first retaining member 206 therein. In other embodiment, the first retaining member 206 may be stored within the handle housing 700 using other suitable coupling mechanisms. Advantageously, the handle housing 700 not only maintains the first retaining member 206 in a stationary position, but also protects the first retaining member 206 from outside elements which may interfere with the magnetic force of the first retaining member 206.

In the same vein, similar to the handle housing 700, in one embodiment, the base 104 includes a base housing 702 for retaining, i.e., holding, the second retaining member 208 therein. More specifically, in one embodiment, the base housing 702 includes a second retaining member pocket (not shown), that may be molded or otherwise created during the manufacturing process of the device 100. The second retaining member housing is sized and shaped to hold the second retaining member 208 therein. In other embodiments, the second retaining member 208 may be stored within the base housing 702 using other suitable coupling mechanisms. Advantageously the base housing 702 not only maintains the second retaining member 208 in a stationary position, but also protects the second retaining member 208 from outside elements which may interfere with the magnetic force of the second retaining member 208.

In one embodiment, the handle housing 700 and/or the base housing 702 may be covered by or made of a plastic material, e.g., ABS plastic. In other embodiments the handle housing 700 and/or the base housing 702 may be made of aluminum, a composite material, or another polymer material. The material may or may not include a silver, gold, metallic, and/or colored finish to provide an aesthetically pleasing look to the device 100.

Figure 8:
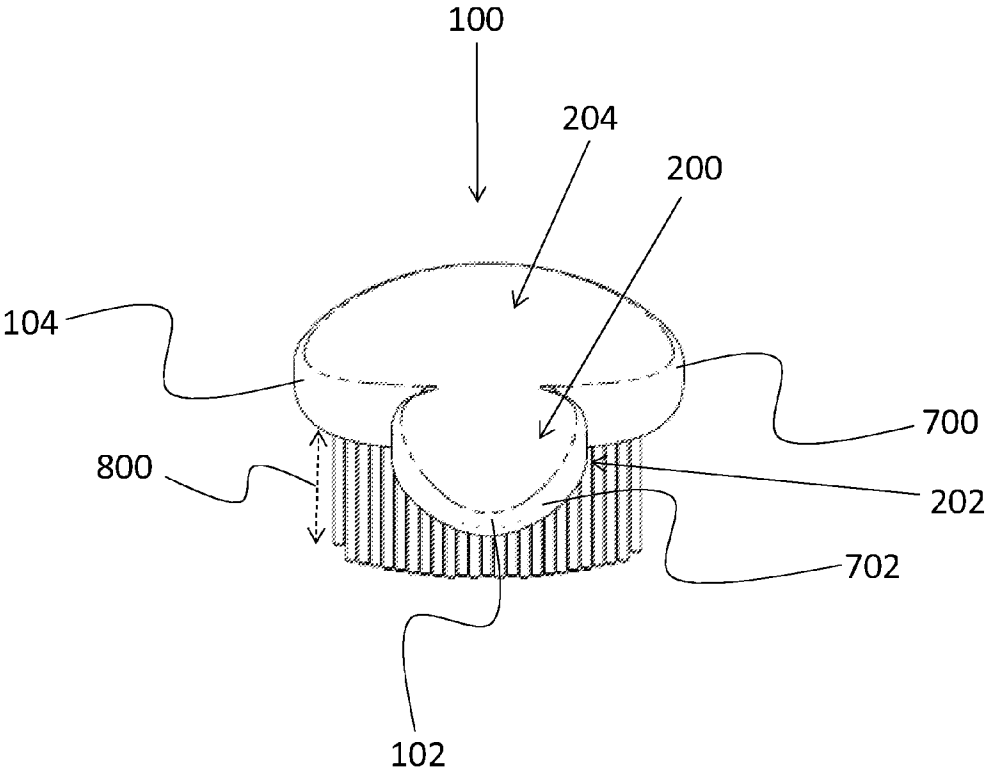
FIG. 8 is an elevational rear view of the dual-purpose hair styling and retention device of FIG. 1 depicting the plurality of bristles having a bristle length.
Figure 9:
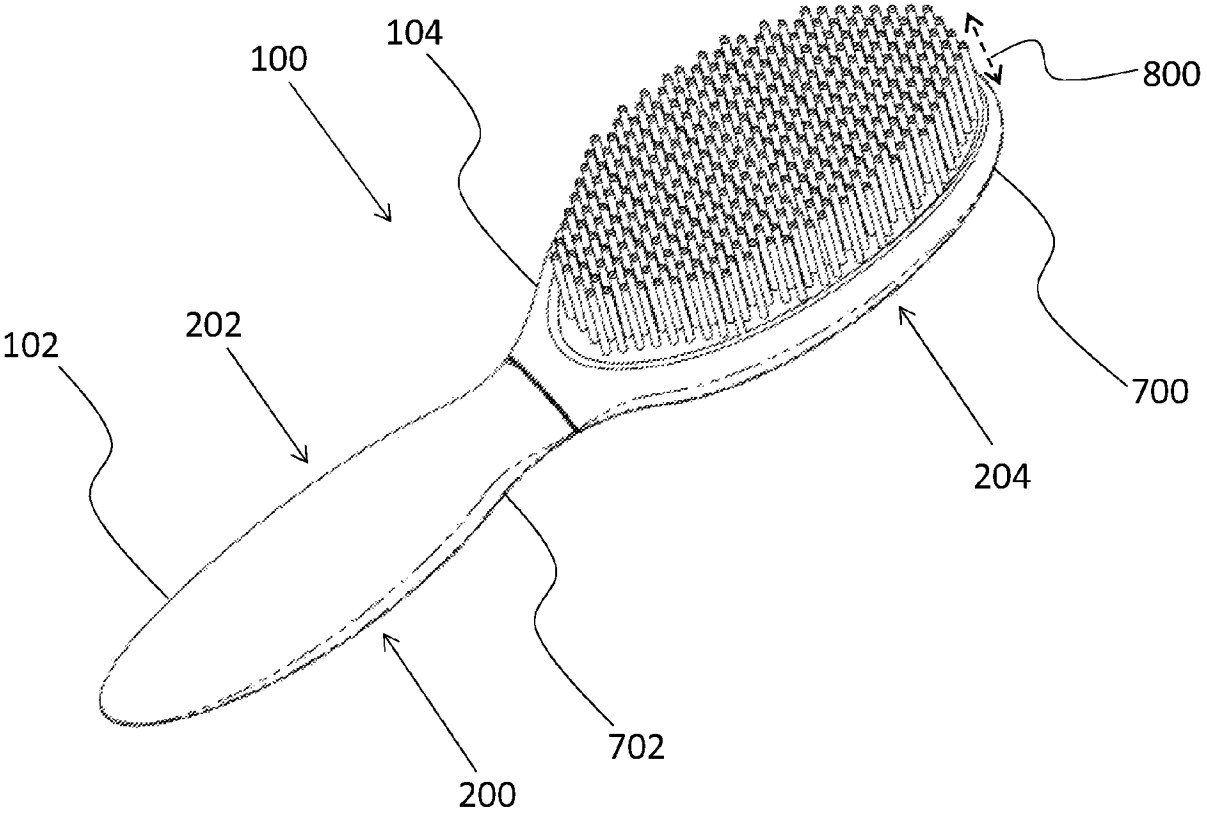
FIG. 9 is a perspective top view of the dual-purpose hair styling and retention device of FIG. 1.

With reference now to FIGS. 8 and 9, depicting a rear elevational view and a perspective view of the device 100, respectively, in one embodiment, in order to avoid the flexible coupling member 300 (FIG. 3) from becoming entangled in someone's hair, the handle housing 700 and the base housing 702 substantially conceal the flexible coupling member 300 when the device 100 is in the extended configuration. The term "substantially conceal" is defined herein as allowing at least one nominal opening between the handle 102 and the base 104. For example, a nominal opening may be created when the handle 102 is pulled in a direction away from the base 104 before the base 104 is coupled to the handle 102 (or vice versa). In other embodiments, the flexible coupling member 300 may be exposed to an outside ambient environment, such as that depicted when the device 100 is in the hair-retention configuration (FIG. 3).

In one embodiment, once the operator is finished cutting, blow-drying, styling, etc., the user's hair, the operator may decouple the bottom surface 204 of the base 104 from the bottom surface 200 of the handle 102. Thereafter, the operator may again grasp the hand gripping surface 202 of the handle 102 and style, e.g., brush, someone's hair with the bristles 110 in contact with the user's hair. In one embodiment, the bristles 110 may include a bristle length 800 between approximately 0.5 of an inch to 1.0 inch. In other embodiments, the bristle length 800 may be outside of this range. In one embodiment, the bristles 110 include a uniform bristle length 800. In other embodiments, the bristle length 800 may vary between bristles 110. The process ends at step 1008.

A dual-purpose hair styling and retention device has been disclosed that includes a base, having one or more bristles coupled thereto, pivotally coupled to a handle. The device includes an extended, i.e., open, configuration and a hair-retention, i.e., closed, configuration. In the extended configuration, an operator, such as a hair stylist or the user, may grasp the handle to style hair in a similar manner as a traditional hairbrush. In the hair-retention configuration, a top surface of the handle may be coupled to a user's head and a bottom surface of the handle may be coupled to and magnetically retained with the base. Advantageously, in the hair-retention configuration, an operator may lay sections of the user's hair over the bristles in order to retain the sections of the user's hair, while allowing the operator to blow-dry, curl, or otherwise style the unrestrained sections of the user's hair in a quick and efficient manner. Other features of the invention have been disclosed, but are not limited to the particular details disclosed herein.

What is claimed is:

1. A dual-purpose hair styling and retention device comprising:

a handle having a concaved top surface and a bottom surface opposite the top surface, the top surface and the bottom surface forming a hand gripping surface;

a base pivotally coupled to the handle, the base having an upper surface and a concaved bottom surface opposite the upper surface, the upper surface including a plurality of bristles coupled thereto;

a male fastener fixedly coupled to the base;

a female fastener formed in the handle that is sized and shaped to accept the male fastener within the female fastener to join the handle to the body;

a flexible rubber coupling member interposed between the male fastener into the female fastener that pivotally couples the base to the handle when the male fastener and female fastener are separated;

the device having an extended configuration in which the handle extends from the base to expose the hand gripping surface wherein the male fastener and flexible coupling member are concealed within the handle and female fastener; and the device having a hair-retention configuration in which the bottom surface of the base is selectively coupled to the bottom surface of the handle to at least partially obstruct the bottom surface of hand gripping surface and leave exposed at least a portion of the plurality of bristles, the concaved top surface shaped to contour to a top of a user's head in the hair-retention configuration a first magnet coupled to the handle; and a second magnet coupled to the base, the first and second magnets configured to magnetically retain the bottom surface of the base to the bottom surface of the handle in the hair-retention configuration; and wherein the bottom surface of the base is correspondingly concaved to match the concave curvature of the handle for mating engagement of the handle to the base in the hair-retention configuration.

2. The dual-purpose hair styling and retention device according to claim 1, wherein:

the base includes a length and a width; and the plurality of bristles include at least three rows of bristles substantially spanning the length and the width of the base.

3. The dual-purpose hair styling and retention device according to claim 1, wherein:

the handle includes a handle housing sized and shaped to retain the first magnet therein; and the base includes a base housing coupled to the handle housing, the base housing sized and shaped to retain the second magnet therein.

4. A dual-purpose hair styling and retention device comprising:

a curved handle including:

a top head contact surface;

a bottom surface opposite the top head contact surface; and a first magnet interposed between the top head contact surface and the bottom surface; and a base pivotally coupled to the handle, the base including:

an upper portion having a plurality of protrusions coupled thereto;

a lower portion opposite the upper portion;

a second magnet interposed between the upper portion and the lower portion, the first and second magnets being operable to couple the lower portion of the base to the bottom surface of the handle and the top head contact surface having a concave curvature, in a direction away from the plurality of protrusions, shaped to conform to a top of a user's head when the lower portion of the base is coupled to the bottom surface of the handle;

a male fastener fixedly coupled to the base;

a female fastener formed in the handle and being sized and shaped to accept the male fastener therein to join the curved handle to the body; and a flexible rubber coupling member interposed between the male fastener and the female fastener and pivotally couples the base to the handle when the male fastener and female fastener are separated;

wherein the dual-purpose hair styling and retention device is configurable in at least an open configuration and a closed configuration, wherein in the open configuration the male fastener is inserted into the female fastener thereby concealing the male fastener and the flexible coupling member, and the handle extends from the base to expose a hand gripping surface of the handle, and wherein in the closed configuration the lower portion of the base is coupled to the bottom surface of the handle to at least partially obstruct the hand gripping surface; wherein the bottom surface of the base is correspondingly concaved to match a concave curvature of the handle for mating engagement of the handle to the base in the hair-retention configuration.

5. The dual-purpose hair styling and retention device according to claim 4, wherein:

the first magnet is embedded in the handle therein; and the second magnet is embedded in the base.

6. The dual-purpose hair styling and retention device according to claim 4, wherein:

the base includes a length and a width; and the plurality of protrusions include at least two rows of protrusions substantially spanning the length and the width of the base.

* * * * *